US008082903B2

(12) United States Patent
Lehr et al.

(10) Patent No.: US 8,082,903 B2
(45) Date of Patent: Dec. 27, 2011

(54) METHOD FOR OPERATING AN INJECTOR

(75) Inventors: Hans-Peter Lehr, Stuttgart (DE); Erik Tonner, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 318 days.

(21) Appl. No.: 12/304,589

(22) PCT Filed: Nov. 12, 2007

(86) PCT No.: PCT/EP2007/062208

§ 371 (c)(1),
(2), (4) Date: Mar. 24, 2009

(87) PCT Pub. No.: WO2008/071507

PCT Pub. Date: Jun. 19, 2008

(65) Prior Publication Data

US 2010/0065022 A1 Mar. 18, 2010

(30) Foreign Application Priority Data

Dec. 12, 2006 (DE) ..... 10 2006 058 744

(51) Int. Cl.
*F02M 51/00* (2006.01)

(52) U.S. Cl. ..... 123/490; 239/585.5

(58) Field of Classification Search ..... 123/445, 123/472, 478, 480, 490, 494, 498; 239/585.1, 239/585.2, 585.5

See application file for complete search history.

(56) References Cited

U.S. PATENT DOCUMENTS 5,355,854 A * 10/1994 Aubee ..... 123/431
6,021,760 A * 2/2000 Boecking ..... 123/467
6,148,842 A * 11/2000 Kappel et al. ..... 137/79
6,478,013 B1 * 11/2002 Boecking ..... 123/467
6,619,268 B2 9/2003 Rueger et al.
7,422,005 B2 * 9/2008 Hardy et al. ..... 123/490
7,576,473 B2 * 8/2009 Berlemont et al. ..... 310/316.03
2003/0154806 A1 * 8/2003 Rueger ..... 73/865.9
2006/0022554 A1 2/2006 Mennicken
2007/0000303 A1 1/2007 Sutter et al.
2007/0001545 A1 * 1/2007 Schoor et al. ..... 310/317
2007/0182280 A1 * 8/2007 Huber et al. ..... 310/316.03
2008/0184967 A1 * 8/2008 Berlemont et al. ..... 123/480
2009/0045267 A1 * 2/2009 Sutter et al. ..... 239/102.2
2009/0140747 A1 * 6/2009 Perryman et al. ..... 324/537

FOREIGN PATENT DOCUMENTS

DE 103 15 815 10/2004
DE 10 2004 037 255 2/2006

(Continued)

OTHER PUBLICATIONS

International Search Report, PCT/EP2007/062208 dated May 7, 2008.

*Primary Examiner* — John T. Kwon
*Assistant Examiner* — Johnny Hoang
(74) *Attorney, Agent, or Firm* — Kenyon & Kenyon LLP

(57) ABSTRACT

A method is for operating an injector, in particular a fuel injector of an internal combustion engine in a motor vehicle, the injector having a piezoelectric actuator for driving a valve needle coupled, preferably hydraulically, to the actuator. Starting from a starting voltage corresponding to a first operating state of the injector, the actuator is recharged, i.e., charged or discharged, by a predefinable voltage swing to a target voltage corresponding to a second operating state of the injector.

14 Claims, 6 Drawing Sheets

FOREIGN PATENT DOCUMENTS

| | | |
|---|---|---|
| DE | 10 2004 058 971 | 6/2006 |
| GB | 2 366 664 | 3/2002 |
| JP | 10-288119 | 10/1998 |
| JP | 2004-320869 | 11/2004 |
| WO | WO 2005/026516 | 3/2005 |
| WO | WO 2006/061113 | 6/2006 |

* cited by examiner

METHOD FOR OPERATING AN INJECTOR

FIELD OF THE INVENTION

The present invention relates to a method for operating an injector, in particular a fuel injector of an internal combustion engine in a motor vehicle, the injector having a piezoelectric actuator for driving a valve needle coupled, preferably hydraulically, to the actuator.

BACKGROUND INFORMATION

Injectors and methods of this type are known and usually include preselection of an actuator voltage to which the piezoelectric actuator is to be charged and/or recharged to move the valve needle of the injector to a desired position and/or to put the injector in a desired operating state. However, because of aging effects in the piezoelectric actuator itself in particular as well as the mechanical and hydraulic components in the injector, there are changes in the corresponding electrical and/or mechanical parameters of the injector, so that accurate metering of a quantity of fuel to be injected, for example, is impossible over the long term using the known methods. In addition to these aging effects, temperature fluctuations in the area of the injector in particular also cause a change in the electric capacitance of the piezoelectric actuator, resulting in additional inaccuracies in metering fuel or other fluids through the injector or in positioning the actuator in general. In addition, part variations among various injectors, which are assigned to different cylinders of a certain internal combustion engine, for example, result in individual deviations in fuel injection for each cylinder, which are also unwanted.

SUMMARY

Accordingly, example embodiments of the present invention provide a method of the type defined in the introduction, so that increased precision is achieved in metering a fluid that is to be injected even over a relatively long period of time and age-related changes in the injector are at least partially compensated.

In a method of the type defined in the introduction, starting from a starting voltage corresponding to a first operating state of the injector, the actuator is recharged, i.e., charged or discharged, by a predefinable voltage swing to a target voltage corresponding to a second operating state of the injector.

In contrast with the traditional triggering of piezoelectric actuators by injectors in which an absolute voltage level that is to be established is fixedly predefined, the method according to example embodiments of the present invention of taking into account the voltage swing, i.e., the voltage difference, between a starting voltage and the target voltage for the actuator permits a particularly accurate setting of a desired operating state of the injector, in particular also with variable properties of the injector and/or its components. According to example embodiments of the present invention, an actuator travel produced by the piezoelectric actuator is approximately proportional to a corresponding voltage swing of the actuator voltage, regardless of aging effects of the piezoelectric actuator or a temperature-related change in the electric capacitance of the piezoelectric actuator, for example. Through a corresponding regulation of the voltage swing corresponding to a desired operating state, particularly accurate triggering of the piezoelectric actuator and thus the desired operating state for the injector may be achieved accordingly.

According to an example embodiment of the method according to the present invention, the actuator may particularly advantageously be recharged within a predefinable recharging time with a recharging current which depends on the voltage swing. This ensures that for each recharging operation the same predefinable recharging time is needed, whereas the recharging current which is required for recharging the actuator may be selected accordingly. By varying the recharging current during the recharging operation, it is also advantageously possible to adjust a plurality of possible motion profiles of the valve needle in conversion from a first operating state to a second operating state. For example, characteristic working positions and/or travel positions of the valve needle may also be adjusted in this way or even equated among multiple injectors.

In an example embodiment of the method according to the present invention in which the valve needle rests on a valve seat in the first operating state in such a way that the injector is closed, and in which the actuator has a first length at the starting voltage, it is provided that the actuator is discharged by the predefinable voltage swing to the target voltage such that it is shortened to a second length, which is smaller than the first length, to convert the injector from its closed state into its opened state.

In the method according to example embodiments of the present invention, in which the valve needle exerts a feedback effect on the actuator increasing the actuator voltage by a feedback voltage during the opening of the injector and before reaching a needle travel stop corresponding to a completely opened state of the injector, it is advantageously provided that the voltage swing is selected to yield a desired feedback voltage. The feedback effect of the valve needle on the actuator is caused by the fact that the valve needle at first continues to move toward the actuator even after the end of energization of the actuator, and it exerts a corresponding force on the actuator—which is substantially at rest after the end of energization—resulting in a feedback voltage corresponding to the piezoelectric effect. The specification, according to example embodiments of the present invention, of the voltage swing used to open the injector allows an inference about the actuator travel corresponding to the voltage swing and thus about the distance traveled by the valve needle during the opening operation of the injector and/or during energization of the actuator. With a relatively large voltage swing used to discharge the actuator and/or to open the injector, the valve needle has already traveled a correspondingly relatively great distance away from its valve seat to its needle travel stop during the triggering of the actuator, so that it subsequently need only travel a relatively short distance to its needle travel stop, thereby producing a correspondingly relatively low feedback voltage. With a comparatively low voltage swing selected for the opening operation of the injector, this accordingly yields a greater distance for the valve needle up to its needle travel stop after the end of energization, so that there is a comparatively high feedback voltage. Due to the corresponding choice of the voltage swing according to the present invention, it is thus advantageously possible to define the path of the valve needle up to its needle travel stop remaining after the end of energization and thus also the time when the valve needle will strike the needle travel stop, so that even over several operating cycles of the injector and/or even over the entire operating period, for example, accurate fuel injection is implementable. The method according to example embodiments of the present invention may also be advantageously used to equate the time of reaching the particular needle travel stop by the valve needles of multiple injectors to adapt their injection behavior and/or the quantities of fluid injected by them to one another.

Through an appropriate choice of the feedback voltage and specification of a corresponding voltage swing, it is advantageously possible, for example, to predefine a predefinable time for the entire opening operation of the injector.

In the method according to example embodiments of the present invention, the voltage swing is selected in such a way that the valve needle reaches the valve seat and/or a/the needle travel stop when the energization of the actuator is terminated. According to example embodiments of the present invention with such a configuration there is no significant feedback effect of the valve needle on the actuator so that, for example, the effects of the feedback voltage described above advantageously need not be considered, thus resulting in a further increase in precision in triggering of the actuator. In particular, with diminishing feedback voltage, this also yields a larger voltage range that may be used for triggering the actuator, i.e., a larger effectively usable voltage swing.

If the voltage swing for triggering the actuator is selected in such a way that an amount of the first time derivation of the actuator voltage becomes minimal between an end of energization of the actuator and a first change in sign of the first time derivation of the actuator voltage since the end of the energization of the actuator, the configuration described above in which reaching the valve seat and/or the needle travel stop occurs simultaneously with the end of energization of the actuator may be achieved in a particularly accurate manner.

In the method according to example embodiments of the present invention, a recharging time, which is necessary for converting the injector from its opened state to its closed state, is regulated so that accurately maintaining the recharging time is ensured even with changing properties of the injector and/or the piezoelectric actuator.

The recharging time according to example embodiments of the present invention may also be selected in a particularly advantageous manner as a function of a desired closing time within which the valve needle moves from a starting position to its valve seat.

Regulation of the voltage swing according to example embodiments of the present invention is preferably performed for each operating cycle of the injector so that a particularly high precision is achieved in the regulation. The recharging time mentioned above may advantageously be regulated for each operating cycle of the injector according to example embodiments of the present invention.

Regulation of the feedback voltage and/or regulation of the first time derivation of the actuator voltage between an end of the energization of the actuator and a first change in sign of the first time derivation of the actuator voltage since the end of the energization of the actuator and/or regulation of the closing time advantageously take place according to example embodiments of the present invention in every nth operating cycle of the injector, where n>1, so that corresponding steps in the particular regulating method need not be performed in each operating cycle of the injector, thereby saving on resources of a computation unit performing the regulating method in particular, this computation unit being integrated into a control unit controlling the injector, for example.

Implementation of the method according to example embodiments of the present invention in the form of a computer program capable of running on a computer and/or a computation unit of a control unit and suitable for executing the method is particularly important. The computer program may be stored on an electronic memory medium, for example, in such a way that the memory medium may in turn be contained in a control unit, for example.

Additional advantages, features, and details are derived from the following description in which various exemplary embodiments of the present invention are depicted with reference to the drawings. The features mentioned may be provided either alone or in any combination.

DETAILED DESCRIPTION

Figure 1:
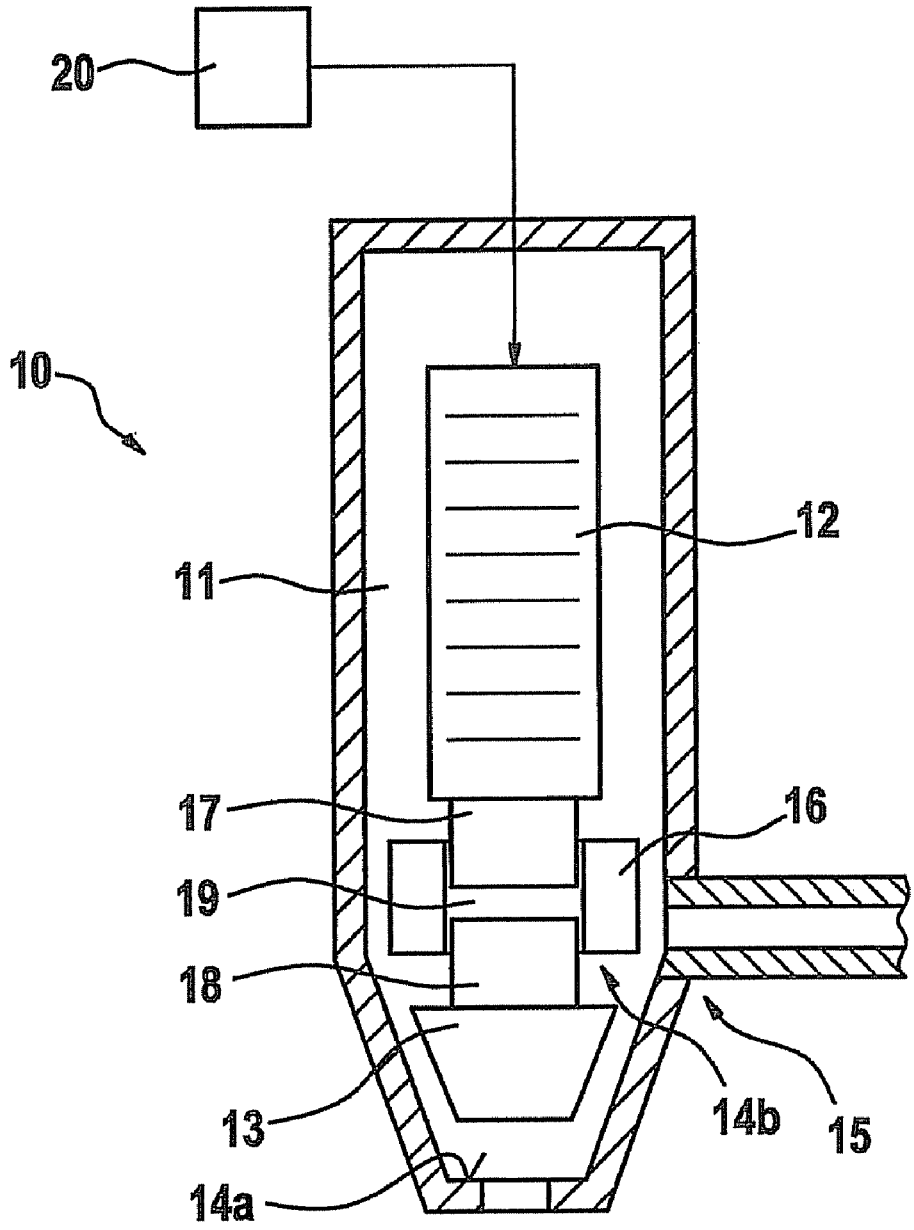
FIG. 1 shows a schematic sectional diagram of an exemplary embodiment of a fuel injector for executing the method according to the present invention, FIG. 2*a* schematically shows a time characteristic of an actuator voltage of a piezoelectric actuator of the fuel injector from FIG. 1.

FIG. 1 shows an injector designed as a fuel injector 10 of an internal combustion engine in a motor vehicle equipped with a piezoelectric actuator 12. Piezoelectric actuator 12, as indicated by the arrow in FIG. 1, is triggered by a control unit 20. In addition, fuel injector 10 has a valve needle 13, which may sit on a valve seat 14*a* in the interior of the housing of fuel injector 10.

When valve needle 13 is lifted up from valve seat 14*a*, fuel injector 10 is opened and fuel is injected. This state is depicted in FIG. 1. This characterizes a completely opened state of fuel injector 10 in that valve needle 13 is in contact with a needle travel stop located in area 14*b*, but not shown in greater detail here, preventing further movement of valve needle 13 away from its seat 14*a*, i.e., toward actuator 12. When valve needle 13 sits on valve seat 14*a*, fuel injector 10 is closed. In other words, the entire vertical travel distance which valve needle 13 is able to travel in the illustration according to FIG. 1 is limited by valve seat 14*a* (closed position) on the one hand and by the needle travel stop in area 14*b* (open position) on the other hand.

The transition from the closed state to the opened state is accomplished with the help of piezoelectric actuator 12. To do so, a voltage, also referred to below as actuator voltage U, is applied to actuator 12, thus producing a change in length of a piezoelectric stack provided in actuator 12, which is in turn utilized to open and/or close fuel injector 10.

Fuel injector 10 also has a hydraulic coupler 15. Hydraulic coupler 15 is situated inside fuel injector 10 and has a coupler housing 16 in which two pistons 17, 18 are guided. Piston 17 is connected to actuator 12 and piston 18 is connected to valve needle 13. A volume 19 enclosed between two pistons 17, 18 causes the transfer of force exerted by actuator 12 to valve needle 13.

Coupler 15 is surrounded by fuel 11 under pressure. Volume 19 is also filled with fuel. Volume 19 is able to adapt to the particular length of actuator 12 over a longer period of time via the guide gap between two pistons 17, 18 and coupler housing 16. However, with short-term changes in the length of actuator 12, volume 19 remains almost unchanged and the change in length of actuator 12 is transmitted to valve needle 13.

Figure 2A:
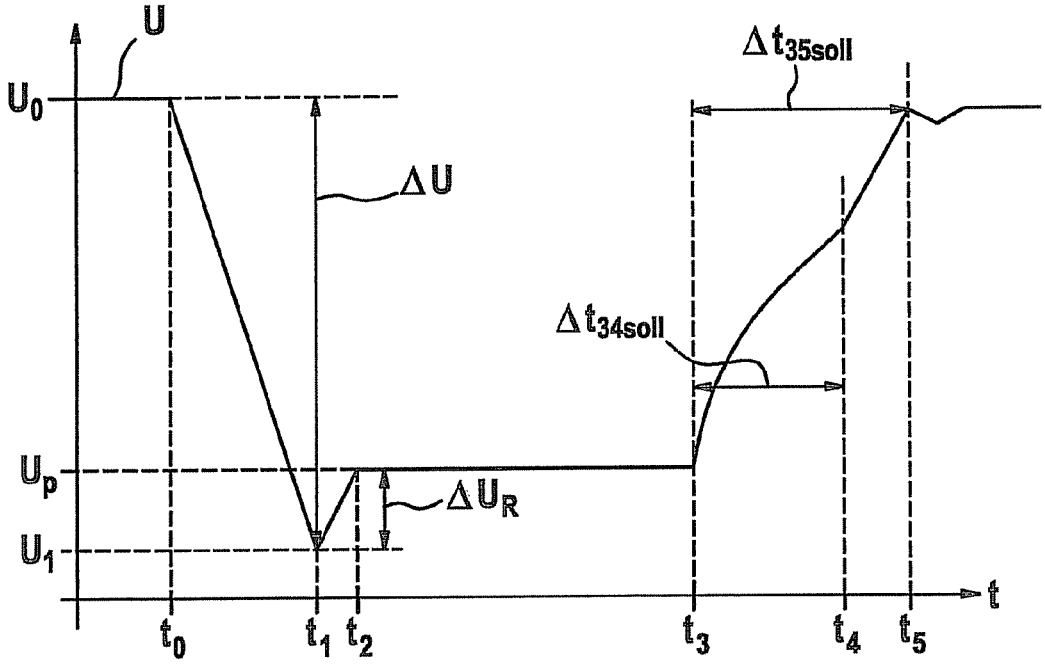
FIG. 2*b* shows a time characteristic of the actuator voltage of the piezoelectric actuator together with a time characteristic of the triggering current of the piezoelectric actuator and a corresponding actuator travel.

FIG. 2*a* schematically shows the time characteristic of actuator voltage U for triggering piezoelectric actuator 12 of injector 10 from FIG. 1. As FIG. 2*a* shows, as part of the method according to example embodiments of the present invention, actuator voltage U is decreased starting from a starting voltage $U_0$ at time $t_0$ by a voltage swing represented by double arrow ΔU to a corresponding target voltage U1 which is applied to piezoelectric actuator 12 at time $t_1$ (FIG. 1), as is also apparent from FIG. 2*a*. At time $t_1$, actuator 12 is energized, not shown in FIG. 2*a*, i.e., a discharge current corresponding to voltage swing ΔU is applied to actuator 12. However, at this time $t_1$, valve needle 13 moves further toward its needle travel stop 14*b*, which is in the area of coupler housing 16 and thereby exerts a corresponding force on piezoelectric actuator 12. This force is detectable in terms of the measurement technology by voltage $\Delta U_R$, which is also referred to below as feedback voltage and is superimposed on actual actuator voltage U of actuator 12, thereby altering it. At time $t_2$ depicted in FIG. 2*a*, valve needle 13 has reached its needle travel stop 14*b* and has thus assumed its resting position, corresponding to a completely opened state of injector 10. Accordingly, valve needle 13 then exerts no further pressure on actuator 12 and voltage $U_p$, which is essentially constant over time and is also referred to as a plateau voltage, is established starting at time $t_2$.

Starting at a subsequent time $t_3$, piezoelectric actuator 12 is again triggered, in particular charged by a corresponding charging current, so that actuator voltage U increases back to the value of starting voltage $U_0$ until time $t_5$. During charging, actuator 12 experiences the change in length described above, moving valve needle 13 out of its resting position on needle travel stop 14*b* back to its valve seat 14*a*, characterizing the closed position of injector 10 and/or its closed operating state. After charging, i.e., starting from time t5, the injector is ready for a new operating cycle.

Figure 2B:
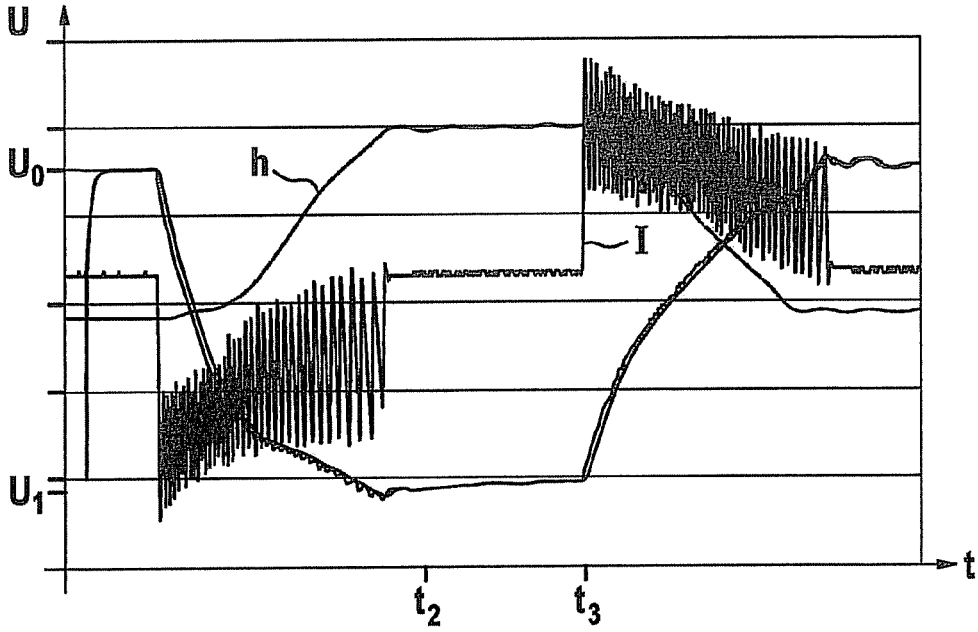

FIG. 2*b* additionally shows a time characteristic of actuator voltage U of actuator 12, this characteristic being detected by the measurement technology and being comparable to the schematic diagram in FIG. 2*a*, together with a time characteristic of charging/discharge current I which is applied to actuator 12 during the intervals ($t_0$; $t_1$) and/or ($t_3$; $t_5$) (FIG. 1). A stroke characteristic h, i.e., the distance actually traveled by valve needle 13, is also shown in FIG. 2*b*.

Recharging of actuator 12 by triggering with a predefinable voltage swing ΔU (FIG. 2*a*) and/or a corresponding recharging current I according to example embodiments of the present invention permits particularly accurate triggering of valve needle 13 and thus, for example, particularly accurate metering of fuel through injector 10. According to example embodiments of the present invention, to implement voltage swing ΔU which is to be applied during the discharge operation of actuator 12, a regulating method is used, adjusting a discharge current $I_E$ as a function of voltage swing $\Delta U_{setpoint}$ to be set. A corresponding regulator structure is diagrammed schematically in FIG. 4*a*.

Figure 4A:
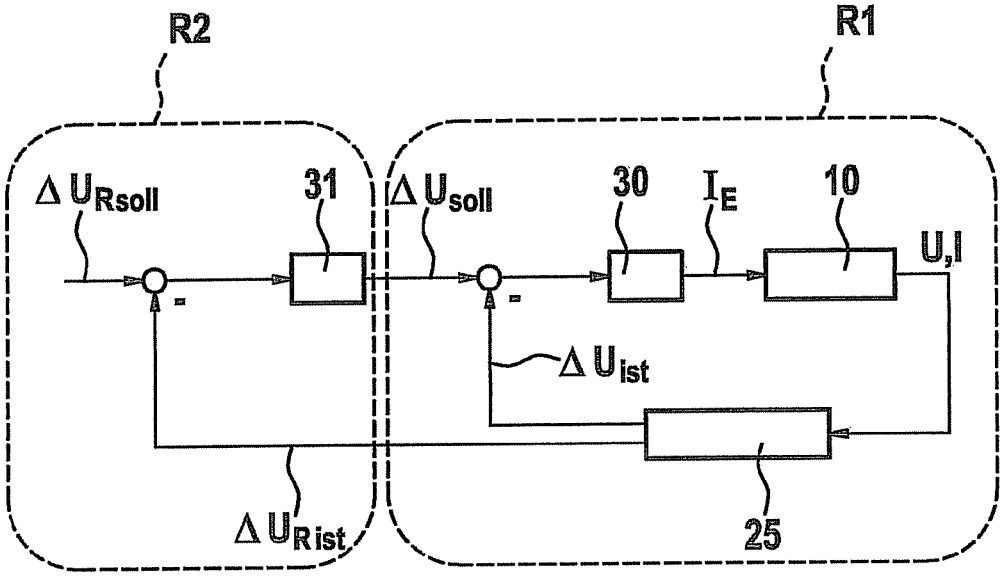

First part R1 of the regulator illustrated in FIG. 4*a* receives, as a setpoint variable, voltage swing $\Delta U_{setpoint}$ which is to be set and is processed in a subtractor, not identified further here, together with voltage swing $\Delta U_{actual}$ that actually occurs to yield a corresponding system deviation. This system deviation is sent to a function block 30, which may be designed, for example, as a characteristic line and/or an engine characteristics map and transforms the system deviation into a discharge current IE with which piezoelectric actuator 12 is to be triggered in a subordinate regulating cycle to minimize system deviation $\Delta U_{setpoint}-\Delta U_{actual}$. Discharge current IE is sent to a function block representing injector 10; the variables of actuator voltage U and actuator current I, which are derived from triggering with discharge IE and detected by control unit 20 (FIG. 1) using the measurement technology, are sent to an analyzer unit 25, preferably also implemented in control unit 20.

On the one hand, analyzer unit 25 ascertains actual voltage swing $\Delta U_{actual}$ from variables U, I detected by measurement technology and sent to it, by subtracting prevailing actuator voltage U from starting voltage $U_0$, for example. On the other hand, analyzer unit 25 also ascertains an actual variable $\Delta U_{Ractual}$ (to be described below) from variables U, I sent to it.

Efficient regulation of desired voltage swing ΔU during a discharge operation of actuator 12 for opening injector 10 is indicated by regulating circuit R1 described above. A comparable voltage swing ΔU may also be used, for example, for charging actuator 12, in particular to move injector 10 from an opened state to a closed state. Here again, regulator R1 described above may be used. By regulating voltage swing ΔU according to example embodiments of the present invention, it is always certain that a desired actuator travel h is established, regardless of aging effects on piezoelectric actuator 12 and/or the other components of injector 10.

The time at which valve needle 13 of injector 10 has actually reached its needle travel stop 14*b* (FIG. 1) and which is labeled with reference numeral $t_2$ in FIG. 2*a* is of particular interest for accurate control of the operation of injector 10, so the operating method according to example embodiments of the present invention provides not only for regulation of voltage swing ΔU described above but also for regulation of feedback voltage $\Delta U_R$.

By defining voltage swing ΔU according to example embodiments of the present invention, in addition to the defined recharging of actuator 12, it is advantageously possible to define the path traveled by valve needle 13 starting from its closed position on valve seat 14*a* during energization time $t_0$ through $t_1$ provided for discharging (FIG. 2*a*). At the same time, the remaining travel of valve needle 13 up to its needle travel stop 14*b*, which it travels in period of time $t_1$ to $t_2$, is thus also defined.

Energization time, i.e. recharging time, $t_1-t_0$ is known and predefined by control unit 20 for example, so total opening time $t_2-t_0$ may also be set in this manner through the choice of voltage swing ΔU, i.e., the time between the start of triggering at $t=t_0$ and striking of the valve needle against needle travel stop 14*b* at $t=t_2$.

Regulation of opening time $t_2-t_0$ is made possible by additional regulating circuit R2 according to example embodiments of the present invention, as also illustrated in FIG. 4*a*. According to a desired opening time $t_2-t_0$, a setpoint value $\Delta U_{Rsetpoint}$ is predefined, determining desired feedback voltage ΔUR and accordingly also determining time difference $t_2-t_1$ and thus also influencing t2 itself. Together with actual variable ΔURactual obtained as described above by analyzer unit 25, a corresponding system deviation $\Delta U_{Rsetpoint}-\Delta U_{Ractual}$ is again formed for the feedback voltage, sent to a function block 31 and thereby transformed into a corresponding setpoint value for voltage swing ΔU to be set according to example embodiments of the present invention.

In other words, the combination of regulating circuits R1, R2 illustrated in FIG. 4*a* permits through their interaction the predefinition of a feedback voltage corresponding to opening time $t_2-t_0$ and corresponding to a corresponding voltage swing ΔU for discharging actuator 12 as described above.

Figure 3A:
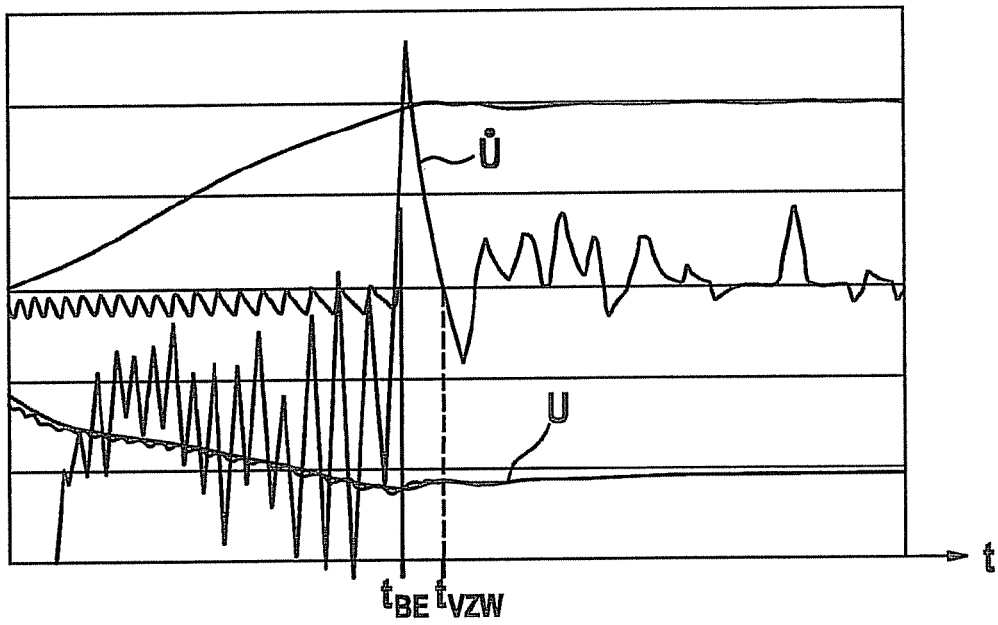
FIG. 3*a* shows a detailed diagram of the time characteristic of the first time derivation of the actuator voltage of the piezoelectric actuator.

The detailed view from FIG. 3*a* gives a time characteristic of actuator voltage U for actuator 12 in the time range between approximately $t_1$ and $t_2$ from FIG. 2*a*. The time labeled with reference numeral $t_{BE}$ in FIG. 3*a* denotes the end of energization of actuator 12 and thus corresponds to the time designated with reference numeral $t_1$ in FIG. 2*a*. According to the present invention, the first change in sign of first time derivation $\mathring{U}$ of actuator voltage U occurring after end $t_{BE}$ of energization is analyzed and interpreted as a feature of valve needle 13 reaching needle travel stop 14*b*, so that in this way time $t_2$ according to FIG. 2*a* is ascertainable. This first change in sign of first time derivation $\mathring{U}$ occurs at time tVZW in the scenario according to FIG. 3*a*. At this time $t_{vzw}$ (=$t_2$ according to FIG. 2*a*) the actual variable for feedback voltage $\Delta U_{Ractual}$ (see FIG. 4*a*) is ascertained according to example embodiments of the present invention and used for the regulation described here. Analysis of first time derivation $\mathring{U}$ (FIG. 3*a*) of actuator voltage U is a more computation-intensive procedure than simple monitoring of actuator voltage U by regulator R1, so the method implemented in regulator R2 (FIG. 4*a*) is preferably performed only every nth operating cycle of injector 10, where n>1, e.g., at every fourth discharge operation in the case of n=4.

Sufficient accuracy in regulation of desired feedback voltage $\Delta U_R$ is achieved in this manner without requiring an unnecessarily great computation power of a computation unit which is provided in control unit 20 and implements the regulating method of regulators R1, R2.

In addition to an analysis of first time derivation $\mathring{U}$ of actuator voltage U of actuator 12, similar detection of reaching needle travel stop 14*b* may occur, for example, with the analysis of second time derivation ü of actuator voltage U or by similar methods with which those skilled in the art are familiar.

In an example embodiment of the method according to the present invention, a recharging time, which is necessary for converting injector 10 from its opened state to its closed state, is regulated.

The particular recharging time is apparent from FIG. 2*a* as a time difference between points in time $t_3$ and $t_5$.

Figure 4B:
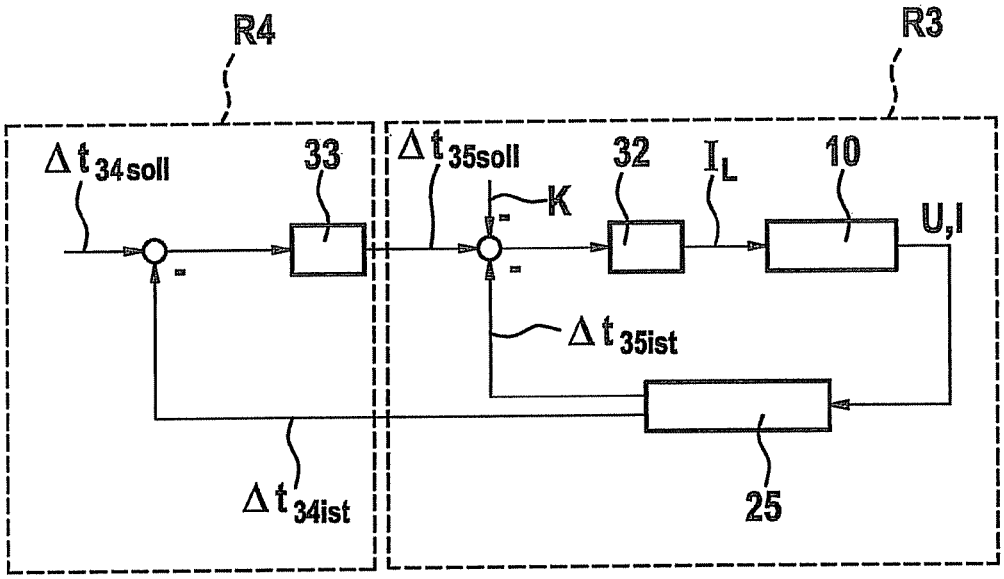

Regulation of recharging time according to example embodiments of the present invention allows particularly accurate closing of injector 10 and may advantageously also be implemented by the regulator structure illustrated in FIG. 4*b*.

The recharging time to be set, within which injector 10 is to be converted from its opened state (time $t_3$) to its completely closed state (time $t_5$), is represented by double arrow $\Delta t_{35setpoint}$ in FIG. 2*a*.

A corresponding setpoint value Δt35setpoint for this recharging time is sent to regulator R3 shown in FIG. 4*b* and is processed there in a substantially conventional manner together with a corresponding actual value $\Delta t_{35actual}$ which is ascertained by analyzer unit 25 to yield a corresponding system deviation, which is sent to a subordinate function block 32. Function block 32 transforms the system deviation into a charging current $I_L$ with which actuator 12 is to be charged during recharging time $t_5-t_3$ to maintain desired recharging time $\Delta t_{35setpoint}$. As already described with reference to regulator R1 from FIG. 4*a*, charging current $I_L$, which is also shown in FIG. 4*b*, acts on function block 10, representing the injector, such that variables U, I which are in fact to be set may be detected and processed in a manner already described by the measurement technology using analyzer unit 25. To improve the regulating quality of regulating circuit R3, a correction value K may also be taken into account in forming system deviation $\Delta t_{35setpoint}-\Delta t_{35actual}$; this correction value depends on regulating difference $\Delta U_{setpoint}-\Delta U_{actual}$ and is also obtained accordingly by regulator R1 (FIG. 4*a*), for example. Correction value K advantageously takes into account the fact that in the case of an enlarged voltage swing ΔU, for example, the charging time for recharging actuator 12 also changes accordingly.

At end $t_5$ (FIG. 2*a*) of the recharging time, actuator 12 is again charged up to its starting voltage $U_0$ and is ready for a renewed operating cycle, i.e., for a subsequent discharge.

Valve needle 13 usually reaches its valve seat 14*a* (FIG. 1) at an earlier time $t_4$ during charging time $t_5-t_3$, i.e., the completely closed operating state of injector 10 is already reached after a time also referred to below as closing time $t_4-t_3$. On reaching valve seat 14*a*, valve needle 13 also exerts a feedback effect on actuator 12, described above in conjunction with the opening operation and/or reaching travel stop 14*b*, this feedback effect being detectable as a change in first time derivation $\mathring{U}$, i.e., as a break in actuator voltage U.

Accurate regulation of actual closing time $t_4-t_3$ takes place according to example embodiments of the present invention by the fact that a value corresponding to desired closing time $\Delta t_{34setpoint}$ is predefined for recharging time $\Delta t_{35setpoint}$. This takes place through regulator R4, also illustrated in FIG. 4*b*, whose corresponding system deviation $\Delta t_{34setpoint}-\Delta t_{34actual}$ is transformed in a function block 33 into corresponding setpoint value $\Delta t_{35setpoint}$ for the recharging time.

By analogy with regulators R1, R2 (FIG. 4*a*), regulator R3 may preferably also be active in each operating cycle of injector 10, i.e., with each charging operation of actuator 12, while regulator R4 is preferably active only in every nth charging operation of actuator 12. This is advantageous in particular because detection of time t4 at which valve needle 13 strikes its valve seat 14*a* according to example embodiments of the present invention is based on analysis of second time derivation Ü of actuator voltage U of actuator 12 and accordingly requires a greater computation effort than the processing of variables U, I used in regulator R3.

If time derivations of actuator voltage U are ascertained by analyzer unit 25, indicated within regulators R1, R3, then they are ascertained accordingly only every n operating cycles, although other variables required for operation of regulators R1, R3 are preferably calculated in each operating cycle as described.

Figure 3B:
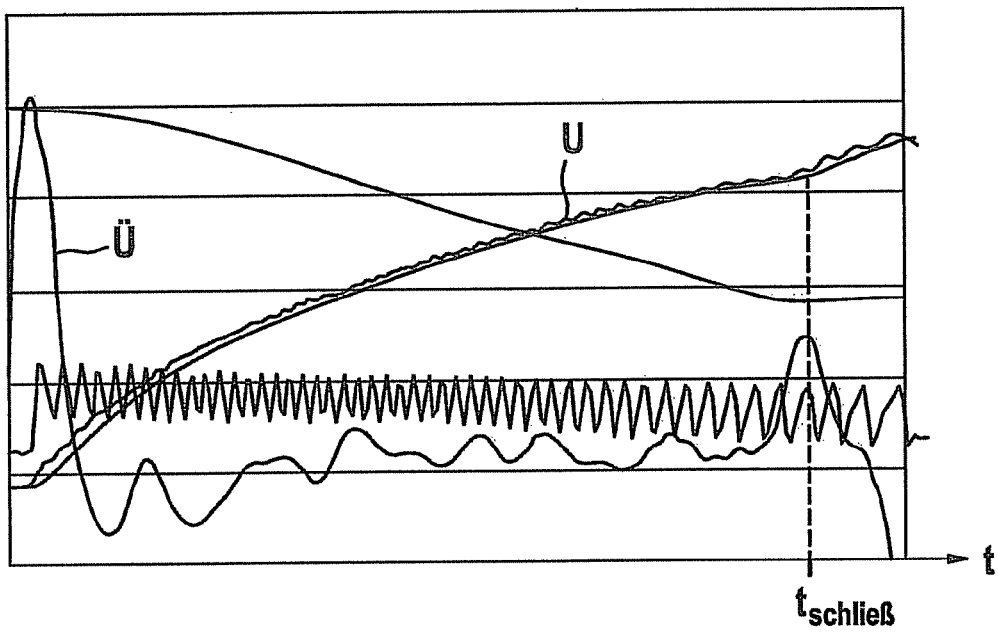
FIG. 3*b* shows a detailed diagram of the time characteristic of the second time derivation of the actuator voltage of the piezoelectric actuator, FIG. 4*a* schematically shows a function diagram of a regulator structure for implementing an example embodiment of the method according to the present invention, FIG. 4*b* schematically shows a function diagram of a regulator structure for implementing an example embodiment of the method according to the present invention, FIGS. 5*a* through 5*c* each show additional examples of a time characteristic of the actuator voltage of the piezoelectric actuator, and FIG. 6 schematically shows a function diagram of another regulator structure of an example embodiment of the method according to the present invention.

FIG. 3*b* shows a detailed view of the time characteristic of second time derivation Ü of actuator voltage U of actuator 12.

According to the present invention, a local maximum of second time derivation Üis interpreted as a feature that indicates closing time $t_{close}$ (=$t_4$ according to FIG. 2*a*). FIG. 3*b* shows the corresponding local maximum of second time derivation Ü at $t=t_{close}$.

Analyzer unit 25 of the regulator structure shown in FIG. 4*b* analyzes second time derivation Ü accordingly, ascertains closing time $t_{close}$ (FIG. 3*b*) and forms from this variable $\Delta t_{34actual}$ as shown in FIG. 4*b*.

Using the regulating method according to example embodiments of the present invention for recharging time $t_5-t_3$ during a closing operation of injector 10 permits particularly accurate setting of actual closing time $t_4-t_3$.

Alternatively, actual closing time $t_{close}$ according to FIG. 3*b* may also be analyzed by analyzing the first time derivation of actuator voltage U or by similar measures with which those skilled in the art are familiar.

Figure 5A:
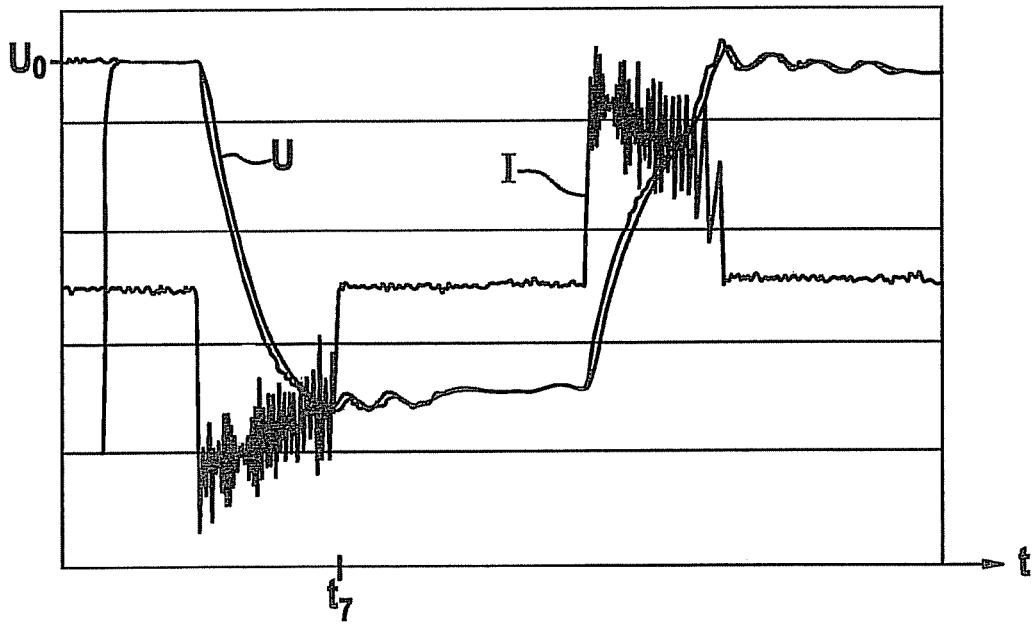
Figure 5B:
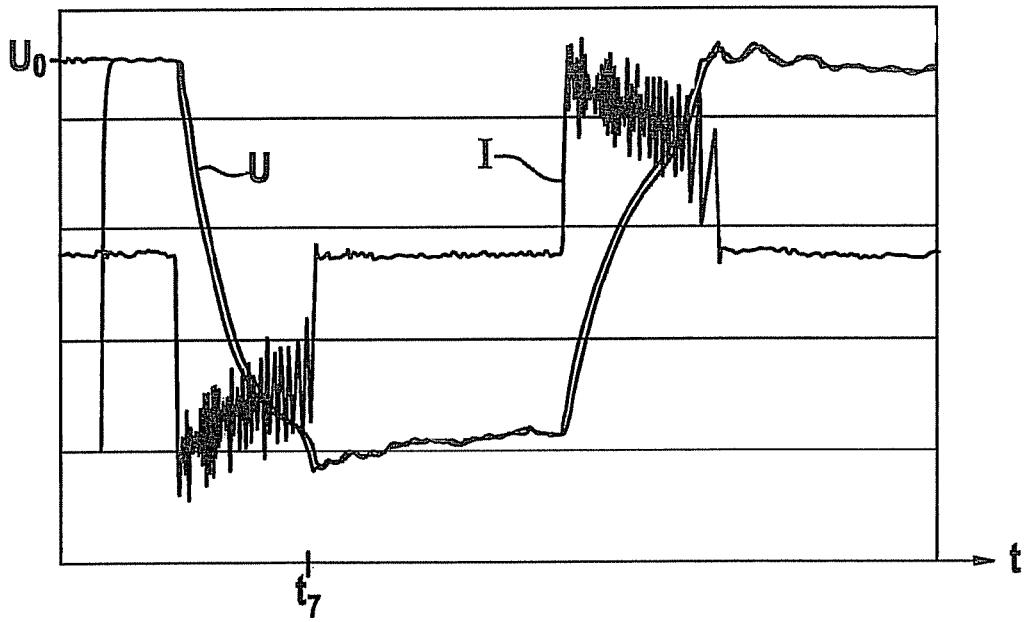

FIGS. 5*a* and 5*b* show additional time characteristics of actuator voltage U, which may occur during operation of injector 10.

It is apparent from both FIGS. 5*a* and 5*b* that fluctuations in actuator voltage U occur during discharging of actuator 12 as part of an opening operation of injector 10 at a time t7, in particular immediately after time $t_7$, these fluctuations occurring, like the feedback voltage described above, due to a feedback effect of components of the hydraulic system and/or valve needle 13 on actuator 12. These fluctuations in actuator voltage U are unwanted and are very effectively avoided in an example embodiment of the operating method according to the present invention.

According to example embodiments of the present invention, the fluctuations in actuator voltage U described above do not occur when the triggering of actuator 12 occurs such that valve needle 13 reaches valve seat 14*a* and/or needle travel stop 14*b* when the energization of actuator 12 is ended. According to the operating method according to example embodiments of the present invention, to achieve such triggering of actuator 12, voltage swing ΔU is selected so that first time derivation $\dot{U}$ of actuator voltage U and/or its amount becomes minimal between an end $t_{BE}$ (FIG. 3*a*) of energization of actuator 12 and a first sign change $t_{vzw}$ (FIG. 3*a*) of first time derivation $\dot{U}$ of actuator voltage U since end $t_{BE}$ of energization of actuator 12.

In other words, the method according to example embodiments of the present invention analyzes first time derivation $\dot{U}$ of actuator voltage U of actuator 12 and minimizes it in time range tVZW-tBE in question, at which valve needle 13 strikes valve seat 14*a* and/or needle travel stop 14*b*. Starting from a fixedly predefined charging and/or discharging time, the first time derivation of actuator voltage U is ascertained, for example, at the end of the charging/discharging time (see variable $\dot{U}_{actual}$ of regulators R5, R6 from FIG. 6). To minimize first time derivation $\dot{U}$ of actuator voltage U, the value zero is predefined as setpoint value $\dot{U}_{setpoint}$ and a corresponding system deviation is sent to function block 26 of regulator R6. According to the present invention, function block 26 forms an average of the system deviation of the last three operating cycles, for example, of injector 10. This average is transformed by subordinate function block 35 into a setpoint value for a voltage swing $\Delta U_{setpoint}$ which is to be set according to example embodiments of the present invention and which produces the minimization of first time derivation $\dot{U}$ of actuator voltage U at the end of the particular recharging operation according to example embodiments of the present invention.

Figure 5C:
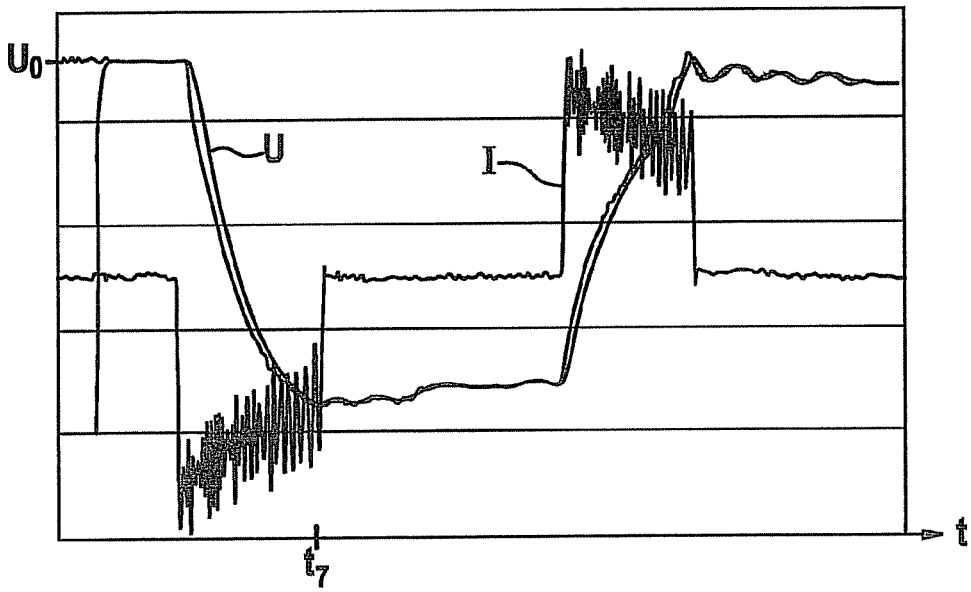

This ensures advantageously that within the fixedly predefined recharging time, namely at the end thereof (see time t7 from FIGS. 5*a*, 5*b*, 5*c*), energization of actuator 12 is terminated on the one hand and on the other hand valve needle 13 comes in contact with the particular element 14*a*, 14*b* limiting its travel path.

Figure 6:
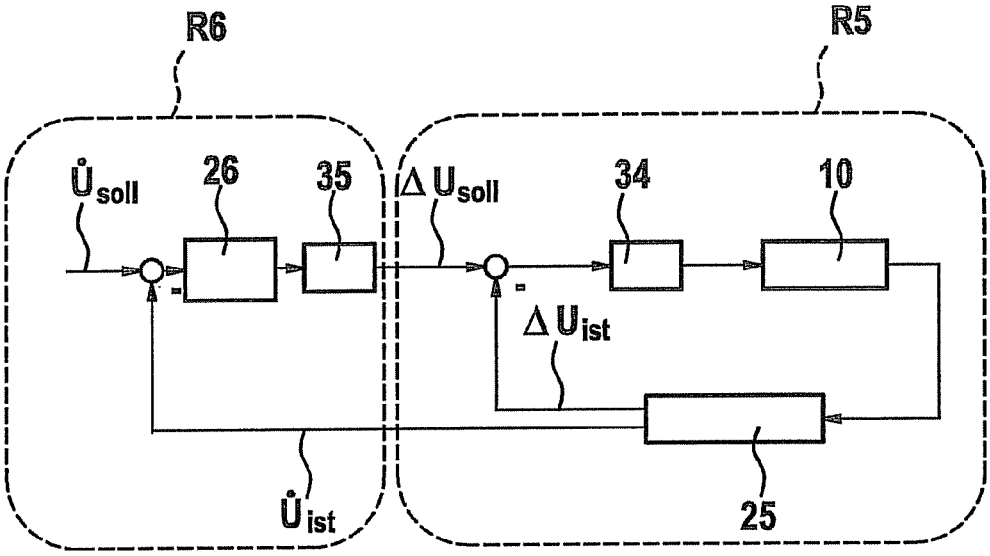

When using the regulating method according to example embodiments of the present invention as shown in FIG. 6, a consideration of any feedback voltages that occur (see FIG. 2*a*) is no longer necessary, which is why regulator R2 from FIG. 4*a* may be readily replaced by regulator R6 from FIG. 6. Function block 34 in regulator R5 corresponds in its function to function block 30 from regulator R1 (FIG. 4*a*).

With the method according to example embodiments of the present invention, a corresponding filtered variable may advantageously be used instead of actuator voltage U.

By analogy with the averaging of the system deviation by function block 26 of regulator R6 (FIG. 6), averaging of the particular system deviation may also be provided with regulator R2 (FIG. 4*a*), R4 (FIG. 4*b*) to increase the stability of the particular regulator.

Regulator R2 (FIG. 4*a*) and/or regulator R4 (FIG. 4*b*) change(s) and/or form(s) the setpoint value for particular subordinate regulator R1 and/or R3, so subordinate regulators R1, R3 are preferably designed in such a way that they operate more rapidly than superordinate regulators R2, R4. This may be accomplished as already described above, e.g., by a corresponding design of the cycle time for superordinate regulators R2, R4, which are preferably activated only once every nth operating cycle. In the sense of particularly rapid regulation by subordinate regulators R1, R3, preferably no averaging of the particular system deviation is provided here.

In general, regulators R1, . . . , R4 may have any characteristics suitable for the prevailing operational purposes, but P (proportional) behavior and/or I (integral) behavior may be considered here in particular.

By regulating voltage swing ΔU, the method according to example embodiments of the present invention advantageously permits, for example, voltage swing ΔU to be accurately kept constant, so that the effects of temperature-induced changes in the properties of actuator 12, which may occur during operation, for example, are reduced to a quantity of fuel actually injected and/or are completely compensated. In other words, by regulating voltage swing ΔU at a predefinable level, preferably a constant level, according to example embodiments of the present invention, temperature compensation of the injection properties of fuel injector 10 and thus also of the quantity of fuel injected may advantageously be achieved in combination with a certain corresponding discharging time.

Temperature-dependent changes in actuator 12, e.g., a change in its electric capacitance, also have an effect on recharging time $\Delta t_{35setpoint}$. Here again, regulation of recharging time $\Delta t_{35setpoint}$ according to the present invention may be used to implement temperature compensation, i.e., to keep a predefined recharging time $\Delta t_{35setpoint}$ constant, for example.

Using the voltage swing and recharging time as control variables according to example embodiments of the present invention also advantageously avoids the need for direct regulation of corresponding currents $I_E$, $I_L$. This is a disadvantage since accuracy in detection of currents by measurement technology is usually relatively low. Actuator voltage U and time t, the variables necessary for regulating according to example embodiments of the present invention, may thus be detected very accurately and permit accurate regulation accordingly.

What is claimed is:

1. A method for operating an injector having a piezoelectric actuator adapted to drive a valve needle coupled to the actuator, comprising:

adjusting a charge of the actuator, starting from a starting voltage corresponding to a first operating state of the injector, by a predefinable voltage swing to a target voltage corresponding to a second operating state of the injector;

wherein the valve needle exerts a feedback effect on the actuator, increasing the actuator voltage by a feedback voltage during opening of the injector and before reaching a needle travel stop corresponding to a completely opened state of the injector, and wherein the voltage swing is selected to yield a desired feedback voltage corresponding to the difference between the target voltage and a plateau voltage, and wherein the plateau voltage is established when the valve needle reaches the needle travel stop.

2. The method according to claim 1, wherein the injector is arranged as a fuel injector of an internal combustion engine in a motor vehicle.

3. The method according to claim 1, wherein the valve needle and the actuator are hydraulically coupled.

4. The method according to claim 1, wherein the charge of the actuator is adjusted within a predefinable adjusting time with a current which depends on the voltage swing.

5. The method according to claim 1, wherein the valve needle rests on a valve seat in the first operating state such that the injector is closed, and in which the actuator has a first actuator length at the starting voltage, the actuator being discharged by the predefinable voltage swing to the target voltage such that the actuator is shortened to a second actuator length smaller than the first actuator length, to convert the injector from the closed state into an opened state.

6. The method according to claim 1, wherein the feedback voltage is selected as a function of a predefinable time for an opening operation of the injector.

7. The method according to claim 1, wherein the voltage swing is selected such that the valve needle reaches at least one of (a) a valve seat and (b) the needle travel stop when energization of the actuator is terminated.

8. The method according to claim 7, wherein the voltage swing is selected such that an amount of a first time derivative of the actuator voltage becomes minimal between an end of the energization of the actuator and a first change in sign of the first time derivative of the actuator voltage since the end of energization of the actuator.

9. The method according to claim 1, wherein a recharging time necessary to convert the injector from an opened state to a closed state is regulated.

10. The method according to claim 9, wherein the recharging time is selected as a function of a desired closing time within which the valve needle moves from a starting position to a valve seat.

11. The method according to claim 1, wherein a regulation of the voltage swing is performed for each operating cycle of the injector.

12. The method according to claim 1, wherein at least one of (a) regulation of the feedback voltage, (b) regulation of a first time derivative of the actuator voltage between an end of an energization of the actuator and a first change in sign of the first time derivative of the actuator voltage since the end of the energization of the actuator, and (c) regulation of a closing time takes place in every nth operating cycle of the injector, wherein $n>1$.

13. A system, comprising:

a control unit of a fuel injector, the control unit adapted to perform a method for operating the injector having a piezoelectric actuator adapted to drive a valve needle coupled to the actuator, the method comprising:

adjusting a charge of the actuator, starting from a starting voltage corresponding to a first operating state of the injector, by a predefinable voltage swing to a target voltage corresponding to a second operating state of the injector;

wherein the valve needle exerts a feedback effect on the actuator, increasing the actuator voltage by a feedback voltage during opening of the injector and before reaching a needle travel stop corresponding to a completely opened state of the injector, and wherein the voltage swing is selected to yield a desired feedback voltage corresponding to the difference between the target voltage and a plateau voltage, and wherein the plateau voltage is established when the valve needle reaches the needle travel stop.

14. A non-transitory computer-readable data-storage medium storing a computer program having program codes which, when executed on a computer, performs a method for operating the injector having a piezoelectric actuator adapted to drive a valve needle coupled to the actuator, the method comprising:

adjusting a charge of the actuator, starting from a starting voltage corresponding to a first operating state of the injector, by a predefinable voltage swing to a target voltage corresponding to a second operating state of the injector;

wherein the valve needle exerts a feedback effect on the actuator, increasing the actuator voltage by a feedback voltage during opening of the injector and before reaching a needle travel stop corresponding to a completely opened state of the injector, and wherein the voltage swing is selected to yield a desired feedback voltage corresponding to the difference between the target voltage and a plateau voltage, and wherein the plateau voltage is established when the valve needle reaches the needle travel stop.

* * * * *